US006906603B2

(12) United States Patent
Jinushi et al.

(10) Patent No.: US 6,906,603 B2
(45) Date of Patent: Jun. 14, 2005

(54) HIGH-FREQUENCY MODULE FOR COMMONALITY OF CIRCUIT BOARD

(75) Inventors: Satoru Jinushi, Miyagi-ken (JP); Akinobu Adachi, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 94 days.

(21) Appl. No.: 10/463,992

(22) Filed: Jun. 17, 2003

(65) Prior Publication Data

US 2003/0231087 A1 Dec. 18, 2003

(30) Foreign Application Priority Data

Jun. 18, 2002 (JP) ..... 2002-003690

(51) Int. Cl.[7] ..... H01P 3/08; H01R 12/00
(52) U.S. Cl. ..... 333/246; 333/33; 439/63
(58) Field of Search ..... 333/246, 260, 333/33, 34; 439/63

(56) References Cited

U.S. PATENT DOCUMENTS 4,609,892 A 9/1986 Higgins, Jr.
5,336,112 A * 8/1994 Michishita et al. ..... 439/581
6,758,680 B2 * 7/2004 Duquerroy et al. ..... 439/63

FOREIGN PATENT DOCUMENTS

| | | |
|---|---|---|
| JP | 59044102 | 3/1984 |
| JP | 60251703 | 12/1985 |
| JP | 07038311 | 2/1995 |
| JP | 09172306 | 6/1997 |
| JP | 10190326 | 7/1998 |
| JP | 10-303780 | 11/1998 |
| JP | 11154823 | 6/1999 |

* cited by examiner

*Primary Examiner*—James H. Cho
(74) *Attorney, Agent, or Firm*—Brinks Hofer Gilson & Lione

(57) ABSTRACT

In a high-frequency module, a setting pattern formed on a circuit board has band-shaped first and second grounding lands, and first and second lands. External conductors of first and second forms of coaxial connectors are solderable to the grounding lands, and central conductors of first and second forms of coaxial connectors are solderable to the first and second lands. Accordingly, the first and second forms of coaxial connectors can be mounted on one circuit board. The circuit board can be manufactured more easily and at a lower cost in comparison with conventional art.

5 Claims, 12 Drawing Sheets

HIGH-FREQUENCY MODULE FOR COMMONALITY OF CIRCUIT BOARD

This application claims the benefit of priority to Japanese Patent Application 2002-003690, filed Jun. 18, 2002.

BACKGROUND OF THE INVENTION

1. Field of the Invention

The present invention relates to a high-frequency module preferably applicable to a short-range radio data communication unit or the like.

2. Description of the Related Art

Conventional high-frequency modules will be described with the drawings. FIG. 14 is a perspective view showing the overview of a first form of a conventional high-frequency module. FIG. 15 is an enlarged plan view of principal parts of a circuit board of the first form of the conventional high-frequency module. FIG. 16 is a cross-sectional view of principal parts of a coaxial connector in the first form of the conventional high-frequency module. FIG. 17 is a schematic side view of the first form of the conventional high-frequency module. FIG. 18 is a plan view of a lower surface of the coaxial connector in the first form of the conventional high-frequency module. FIG. 19 is a plan view showing the circuit board on which the coaxial connector is mounted, in the first form of the conventional high-frequency module. FIG. 20 is a cross-sectional view showing an inspection status of the first form of the conventional high-frequency module.

FIG. 21 is a perspective view showing the overview of a second form of the conventional high-frequency module. FIG. 22 is an enlarged plan view of principal parts of a circuit board of the second form of the conventional high-frequency module. FIG. 23 is a cross-sectional view of principal parts of a coaxial connector in the second form of the conventional high-frequency module, showing a central conductor of the connector. FIG. 24 is a cross-sectional view of principal parts of the coaxial connector in the second form of the conventional high-frequency module, showing an external conductor of the connector. FIG. 25 is a plan view of a lower surface of the coaxial connector in the second form of the conventional high-frequency module. FIG. 26 is a plan view showing the circuit board on which the coaxial connector is mounted, in the second form of the conventional high-frequency module. FIG. 27 is a cross-sectional view showing an inspection status of the second form of the conventional high-frequency module.

Next, the first form of conventional high-frequency module will be described with reference to FIGS. 14 to 20. A wiring pattern 52 is formed on one surface (upper surface) side of a circuit board 51 made up of a print circuit board, and various electric components (not shown) are mounted on the wiring pattern 52, thus a desired electric circuit (transmission reception circuit) is formed.

A metal-plate cover 56 is attached to a necessary portion of the electric circuit, thus a part of the electric circuit is electrically shielded.

Further, a setting pattern 53 for setting a coaxial connector (to be described later) is formed on the circuit board 51.

As particularly shown in FIG. 15, the setting pattern 53 is constituted with four grounding lands 54 arranged in four corners of a square area and two lands 55*a* and 55*b* opposite to each other positioned between the grounding lands 54.

Although not shown here, the grounding lands 54 are connected to an grounding pattern of the wiring pattern 52.

The one land 55*a* is connected to the electric circuit by a leading pattern 52*a*, and the other land 55*b* is connected to a connection pattern 52*b* for an antenna.

Further, an antenna 57 is mounted on the circuit board 51. The antenna 57 is connected to the wiring pattern 52 by the connection pattern 52*b* as a part of the wiring pattern 52.

As particularly shown in FIGS. 16 to 18, a coaxial connector 58 is constituted with an insulating base 59 made of an insulating material, an external conductor 60 attached to the outer periphery of an insulating base 59 in a status where the external conductor is supported (embedded) in the insulating base 59, and a pair of first and second central conductors 61 and 62 attached inside the insulating base 59 in a status where the central conductors are supported (embedded) in the insulating base 59.

The external conductor 60 has a cylindrical member 60*a* and four grounding electrodes 60*b* extended from the cylindrical member 60*a* and provided in four corners of a rectangular lower surface of the insulating base 59. Further, the first central conductor 61 has a fixed contact 61*a* exposed inside the insulating base 59 and an electrode 61*b* extended from the fixed contact 61*a* and provided in a central portion of one side of the lower surface of the insulating base 59. Further, the second central conductor 62 has a movable contact 62*a* which is exposed from a hole 59*a* at the center of the insulating base 59 and which is connectable/disconnectable to/from the fixed contact 61*a* and an electrode 62*b* extended from the movable contact 62*a* and provided in a central portion of another side of the lower surface of the insulating base 59.

Further, the first and second central conductors 61 and 62 are in contact with each other under normal conditions. When the movable contact 62*a* is depressed, the movable contact 62*a* is moved away from the fixed contact 61*a* and electrical continuity is broken. When the depression of the movable contact 62*a* is released, the movable contact 62*a* returns by its spring force and the both contacts become in electrical continuity. In this manner, the coaxial connector 58 is a so-called coaxial connector with switch.

The coaxial connector 58 having the above construction is mounted on the setting pattern 53 of the circuit board 51 and soldered to the setting pattern 53.

That is, as shown in FIG. 19, when the coaxial connector 58 is set, the four grounding electrodes 60*b* are respectively connected to the four grounding lands 54, the electrode 61*b* of the first central conductor 61 is connected to the land 55*b* and connected to the antenna 57, and the electrode 62*b* of the second central conductor 62 is connected to the land 55*a* and connected to the electric circuit.

At this time, the width of the grounding electrodes 60*b* and that of the grounding lands 54 are the same, and connected to each other as indicated by hatched portions in FIG. 19. The width of the electrodes 61*b* and 62*b* and that of the lands 55*a* and 55*b* are the same, and connected to each other as indicated by hatched portions in FIG. 19.

As a result, the antenna 57 is connected via the second central conductor 62 connected to the electric circuit and the first central conductor 61 provided between the antenna 57 and the second central conductor 62.

In the high-frequency module having the above construction, data transmission/reception is performed via the internal antenna 57.

Further, prior to shipment, various electrical inspections are performed on the high-frequency module. As shown in FIG. 20, an inspection member 63 made up of a coaxial connector is inserted into the coaxial connector 58 and the inspections are performed.

When the inspection member 63 is inserted into the coaxial connector 58, an external conductor 64 is connected to the external conductor 60, and the second central conductor 62 is depressed while a central conductor 65 is in contact with the second central conductor 62, so as to break connection with the first central conductor 61 and disconnect the first central conductor from the antenna 57.

In this status, a signal is sent from the inspection member 63 to the electric circuit for inspection of reception status, or a signal is sent from the electric circuit to the inspection member 63 for inspection of transmission status.

When the inspections have been completed, the inspection member 63 is removed, so that the first and second central conductors 61 and 62 return to the contact status.

Next, the construction of a second form of conventional high-frequency module will be described with reference to FIGS. 21 to 27. A wiring pattern 72 is formed on one surface (upper surface) side of a circuit board 71 made up of a print circuit board. Various electric components (not shown) are mounted on the wiring pattern 72, thus a desired electric circuit (transmission reception circuit) is formed.

A metal-plate cover 76 is attached to a necessary portion of the electric circuit, thus a part of the electric circuit is electrically shielded.

Further, a setting pattern 73 for setting a coaxial connector (to be described later) is formed on the circuit board 71.

As particularly shown in FIG. 22, the setting pattern 73 is constituted with two band-shaped grounding lands 74 provided to be opposite to each other with an interval therebetween, and one land 75 provided in a position a little away from the grounding lands 74.

Although not shown here, the grounding lands 74 are connected to an grounding pattern of the wiring pattern 72. The land 75 is connected to the electric circuit by a leading pattern 72*a*.

In this second form of conventional high-frequency module, the connection pattern 52*b* for antenna in the first form of conventional high-frequency module is deleted.

As particularly shown in FIGS. 23 to 25, the coaxial connector 78 is constituted with an insulating base 79 made of an insulating material, an external conductor 80 attached to the outer periphery of an insulating base 79 in a status where the external conductor is supported (embedded) in the insulating base 79, and one central conductor 81 attached to the center of the insulating base 79 in a status where the central conductor is supported (embedded) in the insulating base 79.

The external conductor 80 has a cylindrical member 80*a* and two grounding electrodes 80*b* extended from the cylindrical member 80*a* and provided in opposed two corners of a rectangular lower surface of the insulating base 79. Further, the central conductor 81 has a cylindrical member 81*a* exposed in a hollow of the external conductor 80 and an electrode 81*b* extended from the cylindrical member 81*a* and provided in a central portion of one side of the lower surface of the insulating base 79.

Further, unlike the first form of conventional high-frequency module, the coaxial connector 78 is a coaxial connector without a switch.

The coaxial connector 78 having the above construction is mounted on a setting pattern 73 of the circuit board 71 and soldered to the setting pattern 73.

That is, as shown in FIG. 26, when the coaxial connector 78 is set, the two grounding electrodes 80*b* are respectively connected to the two grounding lands 74 and the electrode 81*b* of the one central conductor 81 is connected to the land 75 and connected to the electric circuit.

At this time, the width of the grounding electrode 80*b* and that of the grounding lands 74 are the same and connected to each other as indicated by hatched portions in FIG. 26, and the width of the electrode 81 and that of the land 75 are the same, and connected to each other as indicated by hatched portions in FIG. 26.

Further, when the high-frequency module having the above construction is used, the antenna 82 as a separate member is inserted into the coaxial connector 78. As a result, in the high-frequency module having this construction, data transmission/reception is performed via the antenna 82 as a separate member.

Further, prior to shipment, various electrical inspections are performed on the high-frequency module. As shown in FIG. 27, an inspection member 83 made up of a coaxial connector is inserted into the coaxial connector 78 and the inspections are performed.

When the inspection member 83 is inserted into the coaxial connector 78, an external conductor 84 is connected to the external conductor 80, and a central conductor 85 is in contact with the central conductor 81.

In this status, a signal is sent from the inspection ember 83 to the electric circuit for inspection of reception status, or a signal is sent from the electric circuit to the inspection member 83 for inspection of transmission status.

When the inspections have been completed, the inspection member 83 is removed, and the antenna 82 as a separate member is attached so that the module can be provided for use.

Generally, the high-frequency module has a first form as a module with antenna and a second form as a module without antenna. In the first form as a module with antenna, to disconnect the module from the antenna 57 upon inspection, the expensive coaxial connector 58 with a switch is used. Further, in the second form as a module without antenna, since it is not necessary to disconnect the module from the antenna upon inspection, the low-price coaxial connector 78 without a switch is used.

The circuit boards 51 and 71 used in the first and second forms of high-frequency modules are different from each other. Further, in the setting patterns 53 and 73 for setting the coaxial connectors 58 and 78, respectively specialized patterns are formed.

In the conventional high-frequency modules, as the circuit boards 51 and 71 in the first and second forms are different from each other, they must be separately manufactured at higher costs.

Further, as the circuit boards 51 and 71 in the first and second forms are different from each other, the specifications must be respectively certified, thus it takes a lot of trouble with the certification.

SUMMARY OF THE INVENTION

Accordingly, an object of the present invention is to attain commonality of circuit board and to provide a low-price high-frequency module which reduces labor in certification.

As a first solution for the above problems, there is provided a high-frequency module having: a circuit board where a wiring pattern is formed at least on one surface side and a desired electric circuit is formed by mounting an electric component on the wiring pattern; and a setting pattern having a conductive pattern formed on the circuit board for setting at least first and second two forms of coaxial connectors, wherein the setting pattern includes band-shaped first and second grounding lands provided to be opposite to each other with an interval therebetween, and first and second lands provided to be opposite to each other between the first and second grounding lands, external conductors of the first and second forms of coaxial connectors are solderable to the first and second grounding lands, and central conductors of the first and second forms of coaxial connectors are solderable to one or both of the first and second lands.

Further, as a second solution, in the above high-frequency module, a transmission reception circuit is formed on the circuit board, and a connection pattern for connection with an antenna is formed on the circuit board.

Further, as a third solution, in the above high-frequency module, the first form of coaxial connector has: mutually-connectable/disconnectable first and second central conductors; an insulating base supporting the central conductors and the external conductors; four grounding electrodes provided in positions of first and second sides of a lower surface of the insulating base except central portions of the first and second sides; and two electrodes provided in central portions of third and fourth sides positioned between the first and second sides of the lower surface of the insulating base, wherein the four grounding electrodes are solderable in positions except middle portions of the first and second grounding lands, the two electrodes are solderable to the first and second lands, the second form of coaxial connector has: an insulating base supporting the central conductors and the external conductors; two grounding electrodes provided in positions of the first and second sides of the lower surface of the insulating base except both ends of the first and second sides; and one electrode provided in one of the central portions of the third and fourth sides positioned between the first and second sides of the lower surface of the insulating base, the two grounding electrodes are solderable in central portions of the first and second grounding lands, and the one electrode is solderable to one of the first and second lands.

Further, as a fourth solution, in the above high-frequency module, a width of the first and second grounding lands is greater than that of the grounding electrodes of the first and second forms of coaxial connectors, and soldering overlaps of the grounding electrodes are formed in positions outside of the first and second grounding lands.

Further, as a fifth solution, in the above high-frequency module, the soldering overlaps of the first and second grounding lands are provided with a notch around boundaries of the grounding electrodes of the first and second forms of coaxial connectors on the first and second grounding lands.

Further, as a sixth solution, in the above high-frequency module, a width of the first and second lands is greater than that of the electrodes of the first and second forms of coaxial connectors, and soldering overlaps are formed in positions outside of the first and second lands.

DETAILED DESCRIPTION OF THE PREFERRED EMBODIMENT

Figure 1:
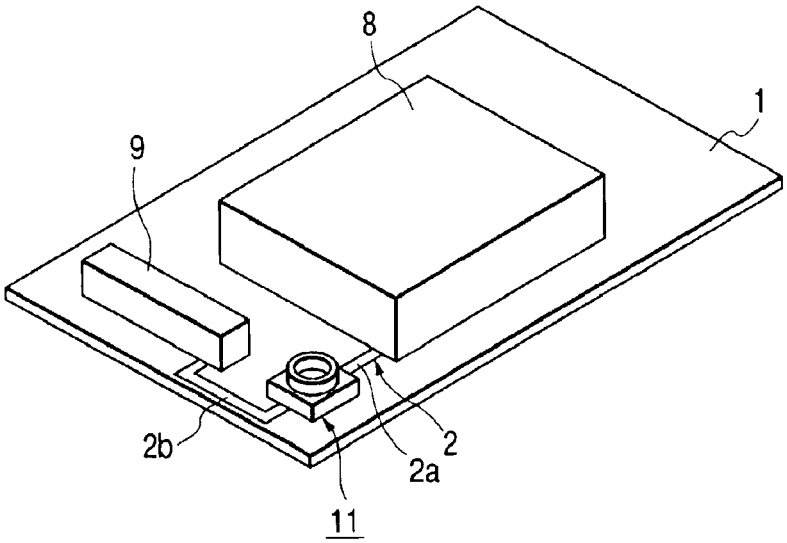
FIG. 1 is a perspective view showing the overview of a first form of the high-frequency module according to the present invention.
Figure 2:
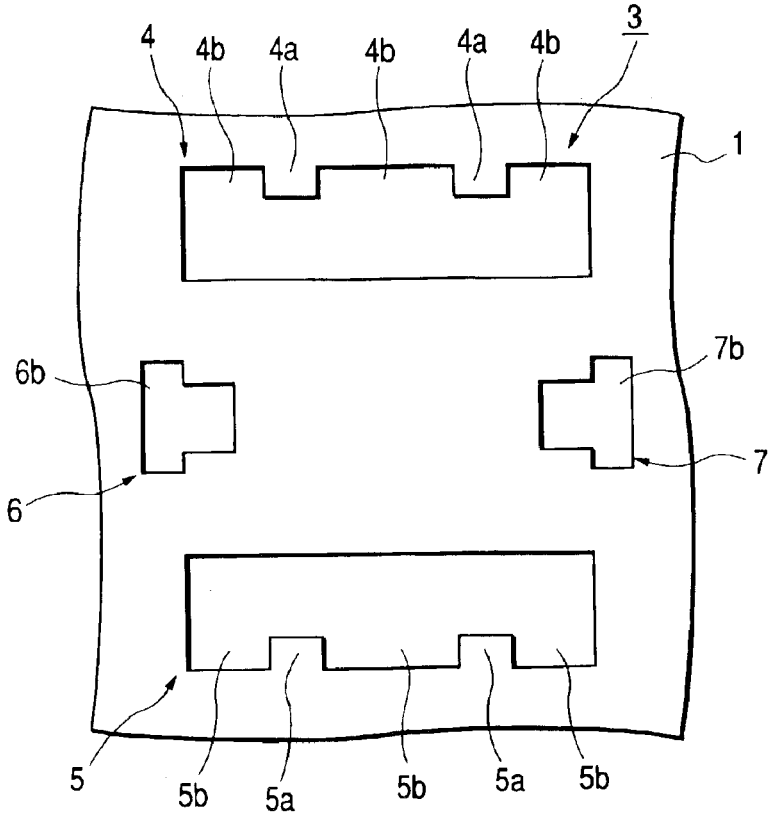
FIG. 2 is an enlarged plan view of principal parts of a circuit board of the first form of the high-frequency module according to the present invention.
Figure 3:
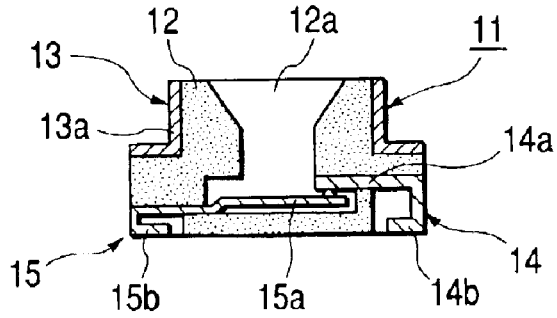
FIG. 3 is a cross-sectional view of principal parts of a coaxial connector in the first form of the high-frequency module according to the present invention.
Figure 4:
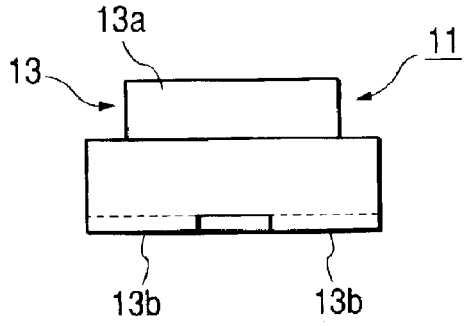
FIG. 4 is a schematic side view of the coaxial connector in the first form of the high-frequency module according to the present invention.
Figure 5:
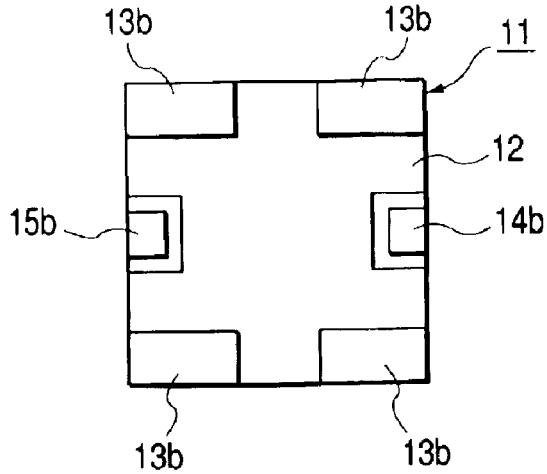
FIG. 5 is a plan view of a lower surface of the coaxial connector in the first form of the high-frequency module according to the present invention.
Figure 6:
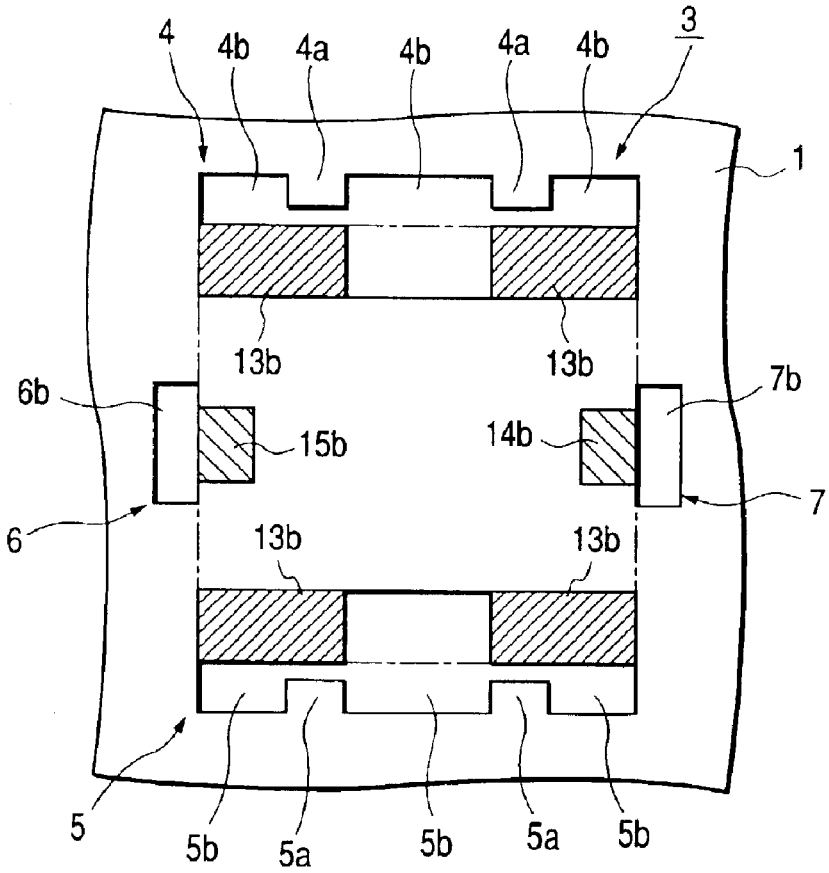
FIG. 6 is a plan view showing the circuit board on which the coaxial connector is mounted, in the first form of the high-frequency module according to the present invention.
Figure 7:
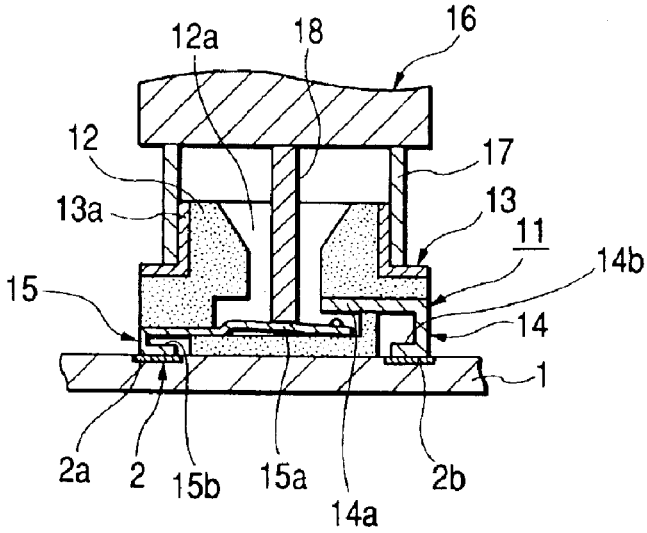
FIG. 7 is a cross-sectional view showing an inspection status of the first form of the high-frequency module according to the present invention.

The high-frequency module according to the present invention will be described with the drawings. FIG. 1 is a perspective view showing the overview of a first form of the high-frequency module according to the present invention. FIG. 2 is an enlarged plan view of principal parts of a circuit board of the first form of high-frequency module according to the present invention. FIG. 3 is a cross-sectional view of principal parts of a coaxial connector in the first form of high-frequency module according to the present invention. FIG. 4 is a schematic side view of the coaxial connector in the first form of high-frequency module according to the present invention. FIG. 5 is a plan view of a lower surface of the coaxial connector in the first form of high-frequency module according to the present invention. FIG. 6 is a plan view showing the circuit board on which the coaxial connector is mounted, in the first form of high-frequency module according to the present invention. FIG. 7 is a cross-sectional view showing an inspection status of the first form of high-frequency module according to the present invention.

Figure 8:
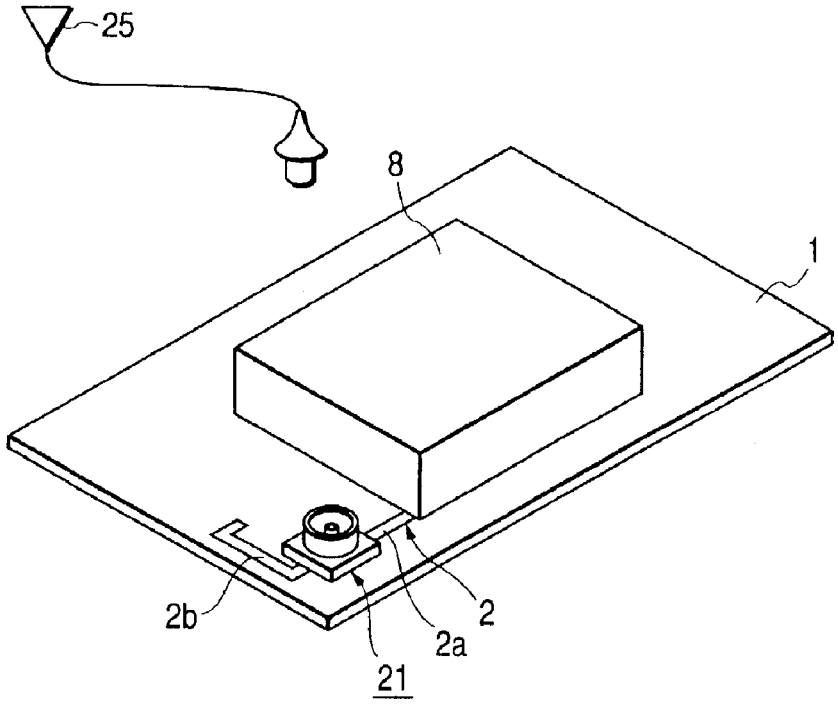
FIG. 8 is a perspective view showing the overview of a second form of the high-frequency module according to the present invention according to the present invention.
Figure 9:
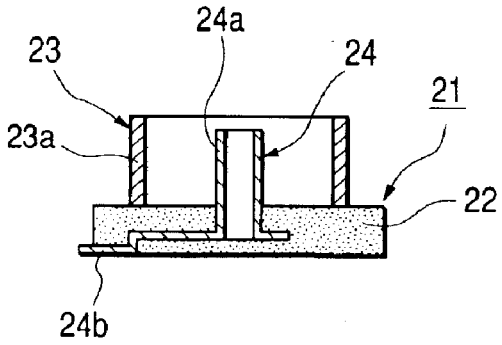
FIG. 9 is a cross-sectional view of principal parts of a coaxial connector in the second form of the high-frequency module, showing a central conductor of the connector according to the present invention.
Figure 10:
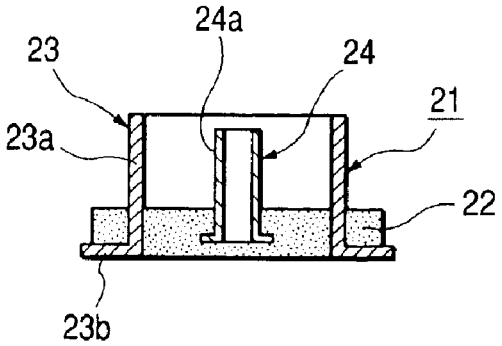
FIG. 10 is a cross-sectional view of principal parts of the coaxial connector in the second form of the high-frequency module, showing an external conductor of the connector according to the present invention.
Figure 11:
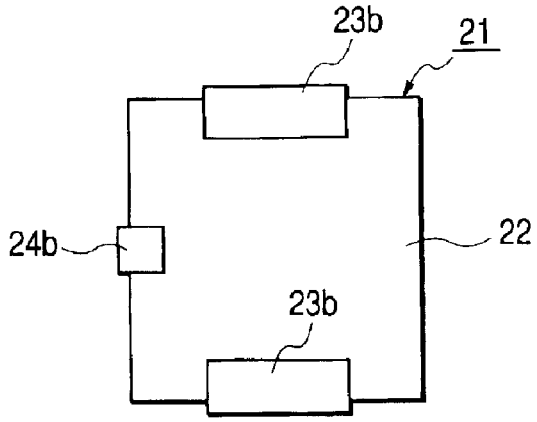
FIG. 11 is a plan view of a lower surface of the coaxial connector in the second form of the high-frequency module according to the present invention.
Figure 12:
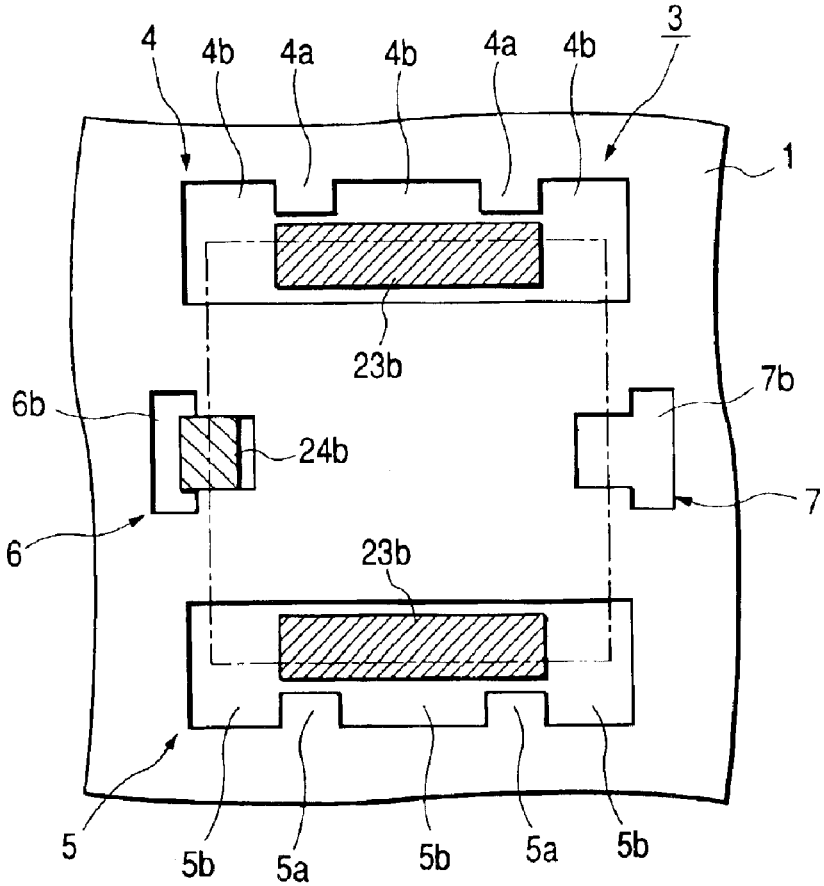
FIG. 12 is a plan view showing the circuit board on which the coaxial connector is mounted, in the second form of the high-frequency module according to the present invention.
Figure 13:
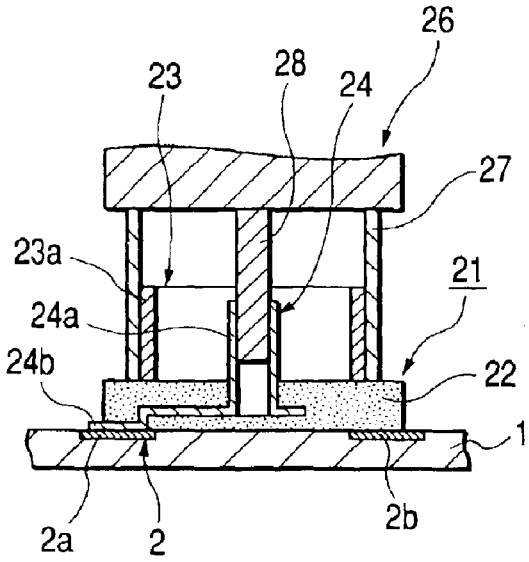
FIG. 13 is a cross-sectional view showing an inspection status of the second form of the high-frequency module according to the present invention.
Figure 14:
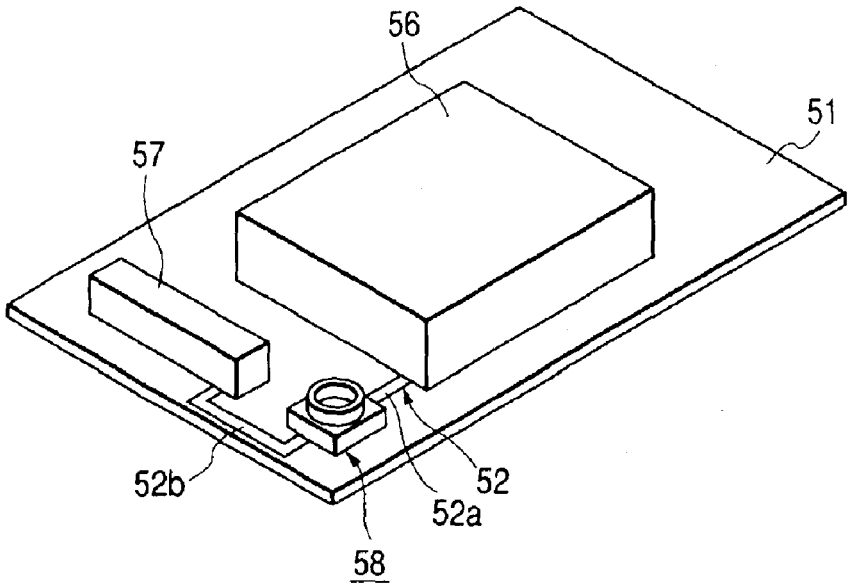
FIG. 14 PRIOR ART
FIG. 14 is a perspective view showing the overview of the first form of a conventional high-frequency module.
Figure 15:
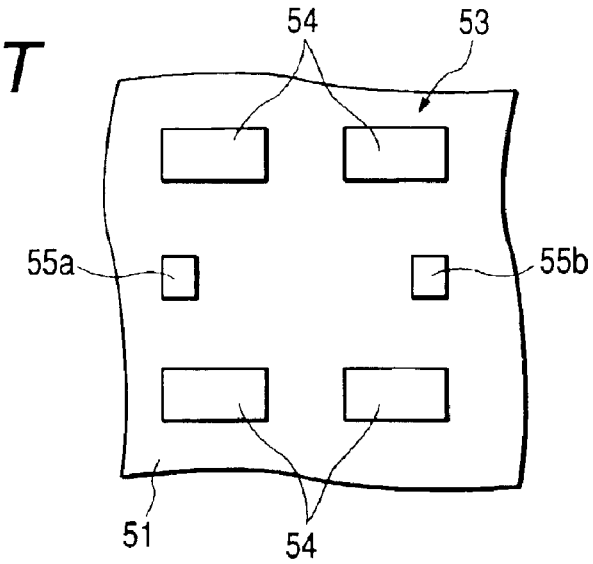
FIG. 15 PRIOR ART
FIG. 15 is an enlarged plan view of principal parts of the circuit board of the first form of the conventional high-frequency module.
Figure 16:
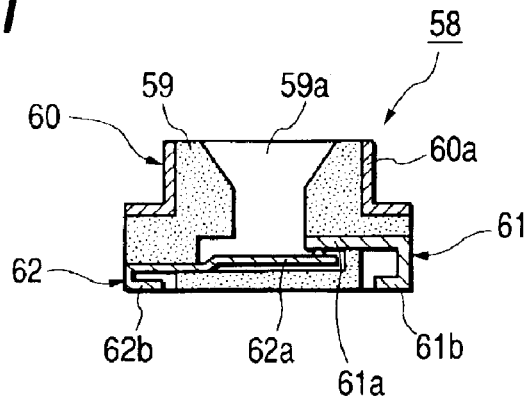
FIG. 16 PRIOR ART
FIG. 16 is a cross-sectional view of principal parts of the coaxial connector in the first form of the conventional high-frequency module.
Figure 17:
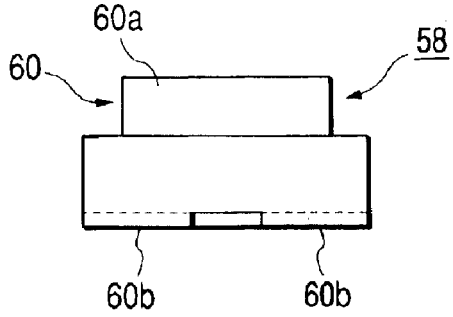
FIG. 17 PRIOR ART
FIG. 17 is a schematic side view of the coaxial connector in the first form of the conventional high-frequency module.
Figure 18:
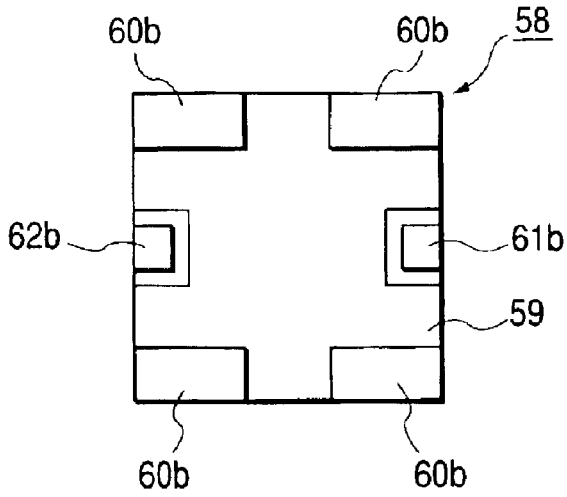
FIG. 18 PRIOR ART
FIG. 18 is a plan view of a lower surface of the coaxial connector in the first form of the conventional high-frequency module.
Figure 19:
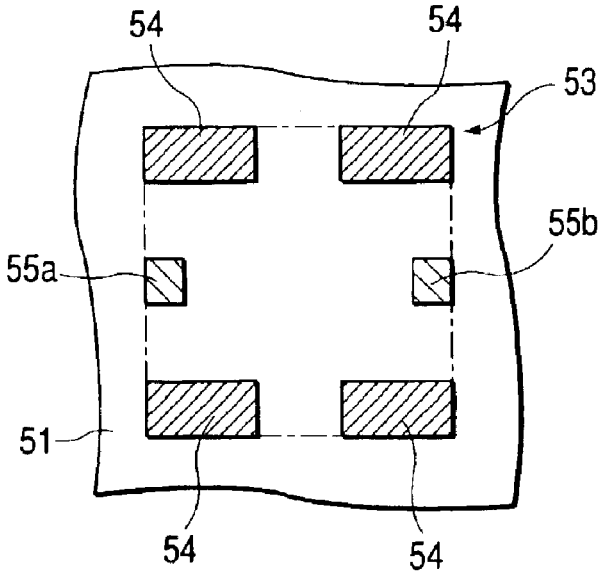
FIG. 19 PRIOR ART
FIG. 19 is a plan view showing the circuit board on which the coaxial connector is mounted, in the first form of the conventional high-frequency module.
Figure 20:
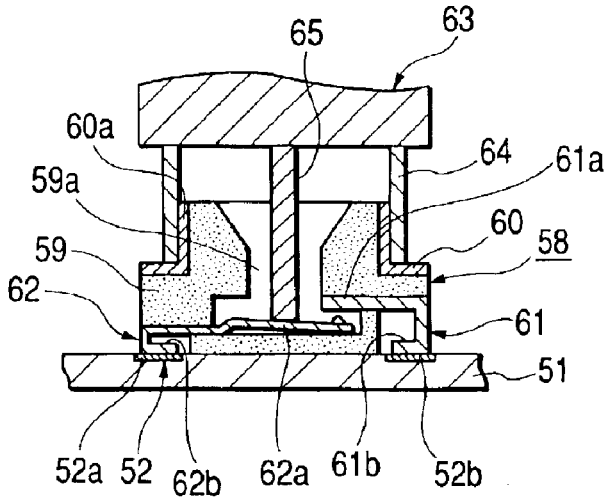
FIG. 20 PRIOR ART
FIG. 20 is a cross-sectional view showing the inspection status of the first form of the conventional high-frequency module.
Figure 21:
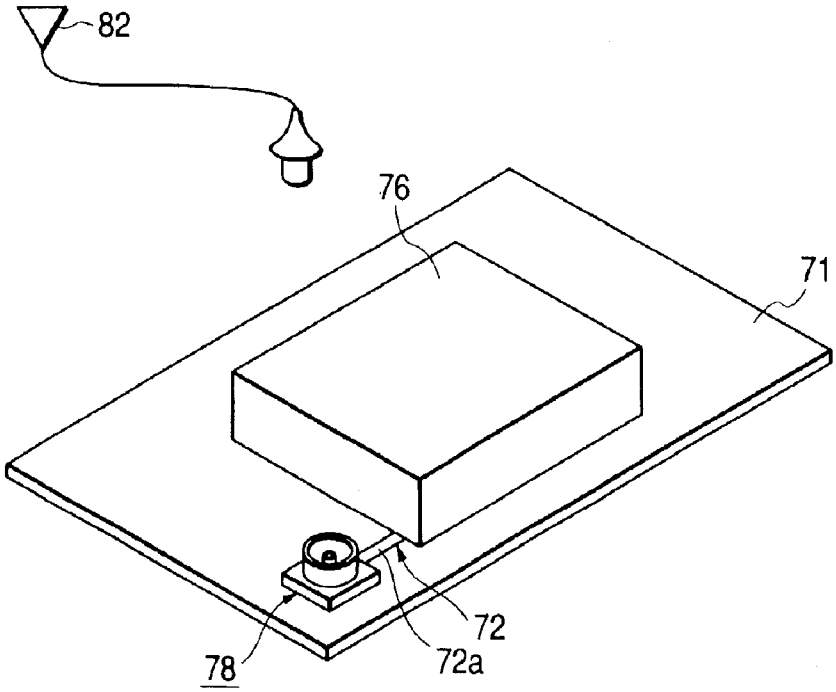
FIG. 21 PRIOR ART
FIG. 21 is an overall perspective view showing the overview of the second form of the conventional high-frequency module.
Figure 22:
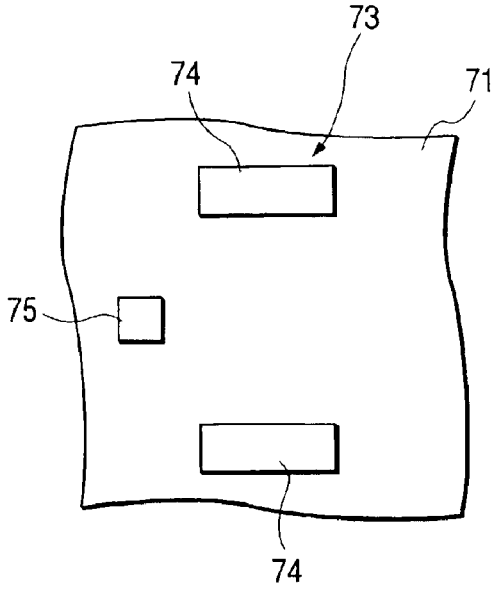
FIG. 22 PRIOR ART
FIG. 22 is an enlarged plan view of principal parts of the circuit board of the second form of the conventional high-frequency module.
Figure 23:
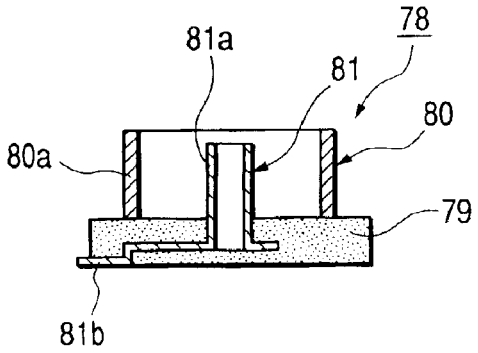
FIG. 23 PRIOR ART
FIG. 23 is a cross-sectional view of principal parts of the coaxial connector in the second form of the conventional high-frequency module, showing the central conductor of the connector.
Figure 24:
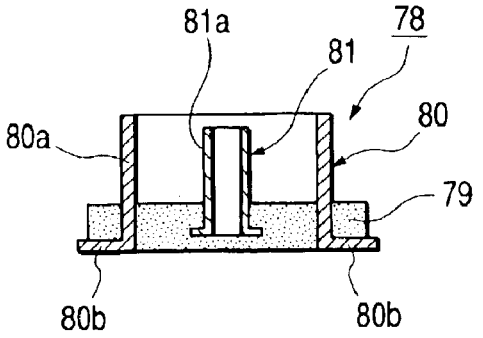
FIG. 24 PRIOR ART
FIG. 24 is a cross-sectional view of principal parts of the coaxial connector in the second form of the conventional high-frequency module, showing the external conductor of the connector.
Figure 25:
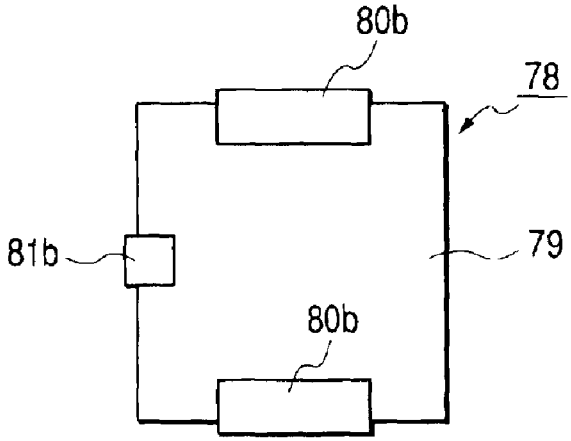
FIG. 25 PRIOR ART
FIG. 25 is a plan view of the lower surface of the coaxial connector in the second form of the conventional high-frequency module.
Figure 26:
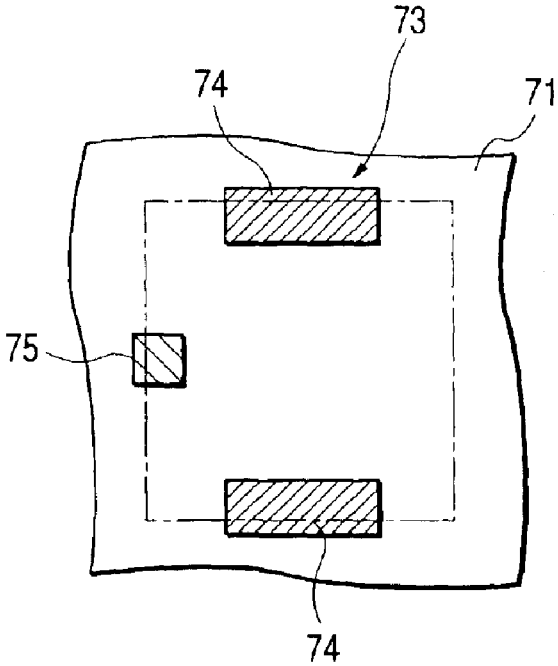
FIG. 26 PRIOR ART
FIG. 26 is a plan view showing the circuit board on which the coaxial connector is mounted, in the second form of the conventional high-frequency module.
Figure 27:
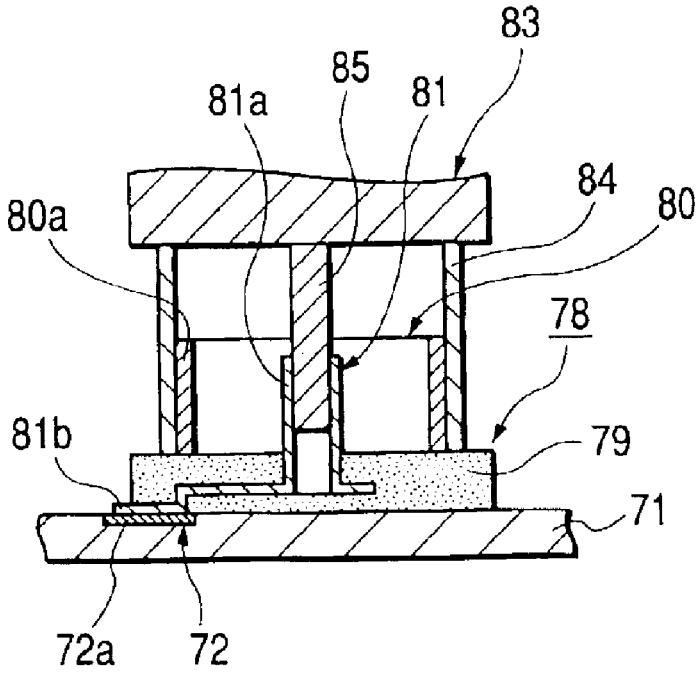
FIG. 27 PRIOR ART
FIG. 27 is a cross-sectional view showing the inspection status of the second form of the conventional high-frequency module.

FIG. 8 is a perspective view showing the overview of a second form of the high-frequency module according to the present invention according to the present invention. FIG. 9 is a cross-sectional view of principal parts of a coaxial connector in the second form of the high-frequency module, showing a central conductor of the connector according to the present invention. FIG. 10 is a cross-sectional view of principal parts of the coaxial connector in the second form of the high-frequency module, showing an external conductor of the connector according to the present invention. FIG. 11 is a plan view of a lower surface of the coaxial connector in the second form of the high-frequency module according to the present invention. FIG. 12 is a plan view showing the circuit board on which the coaxial connector is mounted, in the second form of the high-frequency module according to the present invention. FIG. 13 is a cross-sectional view showing an inspection status of the second form of the high-frequency module according to the present invention.

Next, the construction of a first form of high-frequency module according to the present invention will be described with reference to FIGS. 1 to 7. A wiring pattern 2 is formed on one surface (upper surface) side of a circuit board 1 made up of a print circuit board, and various electric components (not shown) are mounted on the wiring pattern 2, thus a desired electric circuit (transmission reception circuit) is formed.

A metal-plate cover 8 is attached to a necessary portion of the electric circuit, thus a part of the electric circuit is electrically shielded.

Further, a setting pattern 3 for setting a coaxial connector (to be described later) is formed on the circuit board 1.

As particularly shown in FIG. 2, the setting pattern 3 is constituted with band-shaped first and second grounding lands 4 and 5 provided to be opposite to each other with an interval therebetween, and first and second lands 6 and 7 opposite to each other positioned between the first and second grounding lands 4 and 5.

Further, the first and second grounding lands 4 and 5 are provided with notches 4*a* and 5*a* at an interval in the peripheral portions, where wide portions without the notches 4*a* and 5*a* are soldering overlaps 4*b* and 5*b*. Further, the first and second lands 6 and 7 are provided with wide portions as soldering overlaps 6*b* and 7*b* on the outer side.

Although not shown here, the first and second grounding lands 4 and 5 are connected to an grounding pattern of the wiring pattern 2. The first land 6 is connected to the electric circuit by a leading pattern 2*a*, and the second land 7 is connected to a connection pattern 2*b* for an antenna.

Further, an antenna 9 is mounted on the circuit board 1. The antenna 9 is connected to the wiring pattern 2 by the connection pattern 2*b* as a part of the wiring pattern 2.

As particularly shown in FIGS. 3 to 5, the coaxial connector 11 is constituted with an insulating base 12 made of an insulating material, an external conductor 13 attached to the outer periphery of the insulating base 12 in a status where the external conductor is supported (embedded) in the insulating base 12, and a pair of first and second central conductors 14 and 15 attached inside the insulating base 12 in a status where the central conductors are supported (embedded) in the insulating base 12.

The external conductor 13 has a cylindrical member 13*a* and four grounding electrodes 13*b* extended from the cylindrical member 13*a* and provided in positions except central portions of opposed first and second sides (four corners) of a rectangular lower surface of the insulating base 12. Further, the first central conductor 14 has a fixed contact 14*a* exposed inside the insulating base 12 and an electrode 14*b* extended from the fixed contact 14*a* and provided in a central portion of a third side of the lower surface of the insulating base 12. Further, the second central conductor 15 has a movable contact 15*a* which is exposed from a hole 12*a* at the center of the insulating base 12 and which is connectable/disconnectable to/from the fixed contact 14*a* and an electrode 15*b* extended from the movable contact 15*a* and provided in a central portion of a fourth side of the lower surface of the insulating base 12.

Further, the first and second central conductors 14 and 15 are in contact with each other under normal conditions. When the movable contact 15*a* is depressed, the movable contact 15*a* is moved away from the fixed contact 14*a* and electrical continuity is broken. When the depression of the movable contact 15*a* is released, the movable contact 15*a* returns by its spring force and the both contacts become in electrical continuity. In this manner, the coaxial connector 11 is a so-called coaxial connector with switch.

The coaxial connector 11 having the above construction is mounted on the setting pattern 3 of the circuit board 1 and soldered to the setting pattern 3.

That is, as shown in FIG. 6, when the coaxial connector 11 is set, the four grounding electrodes 13*b* are respectively connected to the first and second grounding lands 4 and 5.

At this time, as shown in FIG. 6, as the width of the first and second grounding lands 4 and 5 is greater than that of the grounding electrodes 13*b*, the grounding electrodes 13*b* are soldered in a hatched position in the figure.

That is, the four grounding electrodes 13*b* are positioned in portions except central portions of the first and second grounding lands 4 and 5 in a status where ends of the grounding electrodes are positioned around the notches 4*a* and 5*a*, and at the same time, the soldering overlaps 4*b* and 5*b* partitioned by the notches 4*a* and 5*a* are positioned outside the four grounding electrodes 13*b*. Thus soldering is ensured, and the soldered status can be easily visually observed from the outside.

Further, as shown in FIG. 6, as the width of the first and second lands 6 and 7 is greater than that of the first and second electrodes 14*b* and 15*b*, the first and second electrodes 14*b* and 15*b* are soldered in hatched positions in the figure.

That is, the first and second electrodes 14*b* and 15*b* are positioned inside the first and second lands 6 and 7, and the soldering overlaps 6*b* and 7*b* are positioned outside the first and second electrodes 14*b* and 15*b*. Thus soldering is ensured, and the soldered status can be easily visually observed from the outside.

Further, when the coaxial connector 3 is set on the setting pattern 11, the antenna 9 is connected via the second central conductor 15 connected to the electric circuit and the first central conductor 14 provided between the antenna 9 and the second central conductor 15.

In the high-frequency module having the above construction, data transmission/reception is performed via the internal antenna 9.

Further, prior to shipment, various electrical inspections are performed on the high-frequency module. As shown in FIG. 7, an inspection member 16 made up of a coaxial connector is inserted into the coaxial connector 11 and the inspections are performed.

When the inspection member 16 is inserted into the coaxial connector 11, the external conductor 17 is connected to the external conductor 13, and the second central conductor 15 is depressed while the central conductor 18 is in contact with the second central conductor 15, so as to break connection with the first central conductor 14 and disconnect the conductor from the antenna 9.

In this status, a signal is sent from the inspection member 16 to the electric circuit for inspection of reception status, or a signal is sent from the electric circuit to the inspection member 16 for inspection of transmission status.

When the inspections have been completed, the inspection member 16 is removed, so that the first and second central conductors 14 and 15 return to the status where they are in contact.

Next, the construction of a second form of the high-frequency module according to the present invention will be described with reference to FIGS. 8 to 13. As the circuit board 1 made up of print circuit board has the same construction as that of the circuit board of the first form of the high-frequency module, the corresponding elements have the same reference numerals. The wiring pattern 2 is formed on one surface (upper surface) side of the circuit board 1. Various electric components (not shown) are mounted on the wiring pattern 2, thus a desired electric circuit (transmission reception circuit) is formed.

The metal-plate cover 8 is attached to a necessary portion of the electric circuit, thus a part of the electric circuit is electrically shielded.

Further, the setting pattern 3 for setting the coaxial connector (to be described later) is formed on the circuit board 1.

As the setting pattern 3 is the same structure as that of the first embodiment, the corresponding elements have the same reference numerals and explanations thereof will be omitted.

Although not shown here, the first and second grounding lands 4 and 5 are connected to the grounding pattern of the wiring pattern 2. Further, in the second form of high-frequency module, the first land 6 is connected to the electric circuit by the leading pattern 2*a*, and the second land 7 is connected to the connection pattern 2*b* for antenna, however, the connection pattern 2*b* is not connected to an antenna.

As particularly shown in FIGS. 9 to 13, the coaxial connector 21 is constituted with an insulating base 22 made of an insulating material, an external conductor 23 attached to the outer periphery of the insulating base 22 in a status where the external conductor is supported (embedded) in the insulating base 22, and one central conductor 24 attached to the center of the insulating base 22 in a status where the central conductor is supported (embedded) in the insulating base 22.

The external conductor 23 has a cylindrical member 23*a*, and two grounding electrodes 23*b* extended from the cylindrical member 23*a* and provided in central portions of opposed two sides of a rectangular lower surface of the insulating base 22. Further, the central conductor 24 has a cylindrical member 24*a* exposed in a hollow of the external conductor 23 and an electrode 24*b* extended from the cylindrical member 24*a* and provided in a central portion of one side of the lower surface of the insulating base 22.

Further, unlike the first embodiment, the coaxial connector 21 is a coaxial connector without switch.

The coaxial connector 21 having the above construction is mounted on the setting pattern 3 of the circuit board 1 and soldered to the setting pattern 3.

That is, as shown in FIG. 12, when the coaxial connector 21 is set, the two grounding electrodes 23*b* are respectively connected to the first and second grounding lands 4 and 5.

At this time, as shown in FIG. 12, as the width of the grounding lands 4 and 5 is greater than that of the grounding electrodes 23*b*, the grounding electrodes 23*b* are soldered in hatched portions in the figure.

That is, the 2 grounding electrodes 23*b* are positioned in the central portions of the first and second grounding lands 4 and 5 in a status where ends of the grounding electrodes are positioned around the notches 4*a* and 5*a*, and at the same time, the soldering overlaps 4*b* and 5*b* partitioned by the notches 4*a* and 5*a* are positioned outside the two grounding electrodes 23*b*. Thus the soldering is ensured, and the soldered status can be easily visually observed from the outside.

Further, as shown in FIG. 12, as the width of the first and second lands 6 and 7 is greater than that of the electrode 24*b*, the electrode 24*b* is soldered to the first land 6 in a hatched position in the figure.

That is, the electrode 24*b* is positioned inside the first land 6, and the soldering overlap 6*b* is positioned outside the electrode 24*b*. Thus the soldering is ensured, and the soldered status can be easily visually observed from the outside.

Further, when the high-frequency module having the above construction is used, an antenna 25 as a separate member is inserted into the coaxial connector 21. As a result, in the high-frequency module having this construction, data transmission/reception is performed via the antenna 25 as a separate member.

Further, prior to shipment, various electrical inspections are performed on the high-frequency module. As shown in FIG. 13, an inspection member 26 made up of a coaxial connector is inserted into the coaxial connector 21 and the inspections are performed.

When the inspection member 26 is inserted into the coaxial connector 21, an external conductor 27 is connected to the external conductor 23, and the central conductor 28 is in contact with the central conductor 24.

In this status, a signal is sent from the inspection member 26 to the electric circuit for inspection of reception status, or a signal is sent from the electric circuit to the inspection member 26 or inspection of transmission status.

When the inspections have been completed, the inspection member 26 is removed, and the antenna 25 as a separate member is attached so that the module can be provided for use.

Generally, the high-frequency module has a first form as a module with antenna and a second form as a module without antenna. In the first form as a module with antenna, to disconnect the module from the antenna 9 upon inspection, the expensive coaxial connector 11 with switch is used. Further, in the second form as a module without antenna, since it is not necessary to disconnect the module from the antenna upon inspection, the low-price coaxial connector 21 without switch is used.

In the first and second forms of high-frequency modules, the same circuit board 1 is used. In the first form, the coaxial connector 11 with switch is set on the setting pattern 3, and in the second form, the coaxial connector 21 without switch is set on the setting pattern 3.

Note that in the above embodiment, the high-frequency module is applied to a short-range radio data communication unit, however, it may be applied to other electronic units and the like.

As described above, the present invention provides a high-frequency module having: a circuit board where a wiring pattern is formed at least on one surface side and a desired electric circuit is formed by mounting an electric component on the wiring pattern; and a setting pattern having a conductive pattern formed on the circuit board for setting at least first and second two forms of coaxial connectors, wherein the setting pattern includes band-shaped first and second grounding lands provided to be opposite to each other with an interval therebetween, and first and second lands provided to be opposite to each other between the first and second grounding lands, external conductors of the first and second forms of coaxial connectors are solderable to the first and second grounding lands, and central conductors of the first and second forms of coaxial connectors are solderable to one or both of the first and second lands.

In this manner, as the first and second forms of coaxial connectors can be set on one circuit board, the circuit board can be manufactured more easily and at a lower cost in comparison with the conventional art.

Further, as the commonality of the circuit board can be attained, certification of specifications is necessary only once, and the labor in certification can be reduced in comparison with the conventional art.

Further, in the high-frequency module, a transmission reception circuit is formed on the circuit board, and a connection pattern for connection with an antenna is formed on the circuit board. Therefore, a high-frequency module especially appropriate to a short-range radio data communication unit can be obtained.

Further, in the high-frequency module, the first form of coaxial connector has: mutually-connectable/disconnectable first and second central conductors; an insulating base supporting the central conductors and the external conductors; four grounding electrodes provided in positions of first and second sides of a lower surface of the insulating base except central portions of the first and second sides; and two electrodes provided in central portions of third and fourth sides positioned between the first and second sides of the lower surface of the insulating base, wherein the four grounding electrodes are solderable in positions except middle portions of the first and second grounding lands, the two electrodes are solderable to the first and second lands, the second form of coaxial connector has: an insulating base supporting the central conductors and the external conductors; two grounding electrodes provided in positions of the first and second sides of the lower surface of the insulating base except both ends of the first and second sides; and one electrode provided in one of the central portions of the third and fourth sides positioned between the first and second sides of the lower surface of the insulating base, wherein the two grounding electrodes are solderable in central portions of the first and second grounding lands, and the one electrode is solderable to one of the first and second lands.

In this construction, the first form of coaxial connector with switch and the second form of coaxial connector without switch can be easily set on the setting pattern, and the commonality of circuit board can be easily attained.

Further, in the high-frequency module, a width of the first and second grounding lands is greater than that of the grounding electrodes of the first and second forms of coaxial connectors, and soldering overlaps of the grounding electrodes are formed in positions outside of the first and second grounding lands. Therefore, the grounding electrodes can be infallibly soldered to the grounding lands, and the soldered status can be easily visually observed from the outside, further, inspections can be easily performed.

Further, in the high-frequency module, the soldering overlaps of the first and second grounding lands are provided with a notch around boundaries of the grounding electrodes of the first and second forms of coaxial connectors on the first and second grounding lands. As the amount of solder to the soldering overlaps can be increased, the soldering can be more infallibly made.

Further, in the high-frequency module, a width of the first and second lands is greater than that of the electrodes of the first and second forms of coaxial connectors, and soldering overlaps are formed in positions outside of the first and second lands. Therefore, the electrodes can be infallibly soldered to the lands, and the soldered status can be easily visually observed from the outside, further, inspections can be easily performed.

What is claimed is:

1. A high-frequency module having:

a circuit board where a wiring pattern is formed at least on one surface side and a desired electric circuit is formed by mounting an electric component on the wiring pattern; and a setting pattern having a conductive pattern formed on the circuit board for setting at least first and second forms of coaxial connectors, wherein the setting pattern includes band-shaped first and second grounding lands provided to be opposite to each other with an interval therebetween, and first and second lands provided to be opposite to each other between the first and second grounding lands, wherein external conductors of the first and second forms of coaxial connectors are solderable to the first and second grounding lands, wherein central conductors of the first and second forms of coaxial connectors are solderable to at least one of the first and second lands, wherein the first form of coaxial connector has: mutually-connectable/disconnectable first and second central conductors; an insulating base supporting the central conductors and the external conductors; four grounding electrodes provided in positions of first and second sides of a lower surface of the insulating base except central portions of the first and second sides; and two electrodes provided in central portions of third and fourth sides positioned between the first and second sides of the lower surface of the insulating base, wherein the four grounding electrodes are solderable in positions except middle portions of the first and second grounding lands, wherein the two electrodes are solderable to the first and second lands, and wherein the second form of coaxial connector has: an insulating base supporting the central conductors and the external conductors; two grounding electrodes provided in positions of the first and second sides of the lower surface of the insulating base except both ends of the first and second sides; and one electrode provided in one of the central portions of the third and fourth sides positioned between the first and second sides of the lower surface of the insulating base, wherein the two grounding electrodes are solderable in central portions of the first and second grounding lands, and wherein the one electrode is solderable to one of the first and second lands.

2. The high-frequency module according to claim 1, wherein a transmission reception circuit is formed on the circuit board, and wherein a connection pattern for connection with an antenna is formed on the circuit board.

3. The high-frequency module according to claim 1, wherein a width of the first and second grounding lands is greater than that of the grounding electrodes of the first and second forms of coaxial connectors, and wherein soldering overlaps of the grounding electrodes are formed in positions outside of the first and second grounding lands.

4. The high-frequency module according to claim 3, wherein the soldering overlaps of the first and second grounding lands are provided with a notch around boundaries of the grounding electrodes of the first and second forms of coaxial connectors on the first and second grounding lands.

5. The high-frequency module according to claim 1, wherein a width of the first and second lands is greater than that of the electrodes of the first and second forms of coaxial connectors, and wherein soldering overlaps are formed in positions outside of the first and second lands.

* * * * *